US007406719B2

(12) United States Patent
Aoki

(10) Patent No.: US 7,406,719 B2
(45) Date of Patent: Aug. 5, 2008

(54) GLOVE

(75) Inventor: Akio Aoki, Osaka-shi (JP)

(73) Assignee: Trion Corporation, Osaka (JP)

( * ) Notice: Subject to any disclaimer, the term of this patent is extended or adjusted under 35 U.S.C. 154(b) by 149 days.

(21) Appl. No.: 11/385,934

(22) Filed: Mar. 21, 2006

(65) Prior Publication Data

US 2007/0220655 A1 Sep. 27, 2007

(51) Int. Cl.
*A41D 19/00* (2006.01)

(52) U.S. Cl. ..... 2/161.1; 2/16

(58) Field of Classification Search ..... 2/16, 2/20, 161.1, 161.6, 163
See application file for complete search history.

(56) References Cited

U.S. PATENT DOCUMENTS 5,274,846 A * 1/1994 Kolsky ..... 2/460
6,065,150 A * 5/2000 Huang ..... 2/20
6,202,217 B1 * 3/2001 Karall ..... 2/161.1
6,425,134 B1 * 7/2002 Huang ..... 2/20
6,557,177 B2 * 5/2003 Hochmuth ..... 2/159
6,928,658 B2 * 8/2005 Taira et al. ..... 2/161.6
2002/0166156 A1 * 11/2002 Clark et al. ..... 2/161.7

* cited by examiner

*Primary Examiner*—Katherine Moran
(74) *Attorney, Agent, or Firm*—Knobbe Martens Olson & Bear, LLP

(57) ABSTRACT

A glove according to the present invention comprises a main body wearable with respect to a hand, the main body comprising finger parts, a back-of-hand part connected to the finger parts, a wrist part connected to the back-of-hand part and serving to protect a wrist, and impact alleviating members for alleviating an impact provided in the finger parts and the back-of-hand part and on a back-of-hand side of the wrist part, wherein the impact alleviating members provided in the finger parts continuously extend from base parts of the fingers through fingertips and has such a flexibility that can follow a bending action of the fingers.

8 Claims, 3 Drawing Sheets

GLOVE

BACKGROUND OF THE INVENTION

1. Field of the Invention

The present invention relates to a glove, more particularly to gloves used in lacrosse, ice hockey, baseball and the like.

2. Description of the Related Art

Gloves used in lacrosse are necessarily designed to hold a stick with a strong grip in order to receive and throw a ball with a handle of the stick whose edge is provided with a net portion held with hands. Further, the glove is required to have a superior impact resistance with respect to the hands because the sticks used in the game quite often clash with one another in order to steal the ball, and a strong impact from the sticks used by a competing team is thereby applied to the hands.

Therefore, a thick impact alleviating member serving to absorb and alleviate any impact imposed on the hands is inserted mainly on a back-of-hand side of the glove. The impact alleviating member is formed from a light foamed material made of resin and provided around a wrist part, in a back-of-hand part, and on the back-of-hand side of finger parts of the glove. A palm side of the glove is formed from a relatively thin outer skin so that the stick can be firmly held. The palm-side outer skin is provided with a mesh fabric or the like so that generated sweat can be effectively released.

The impact alleviating member is provided on the back-of-hand side of the finger parts except for parts corresponding to joints of the fingers so that the stick can be firmly held. Therefore, the fingers can be easily bent at the joints.

Because of the foregoing structure, the hands are inevitably vulnerable to the impact when the joint parts are subjected to the competitor's attacks from the sticks intensely clashing with one another in stealing the ball. As a result, the players' hands may be wounded or fractured.

SUMMARY OF THE INVENTION

Therefore, in order to solve the foregoing problem included in the conventional technology, a main object of the present invention is to provide a glove capable of reliably protecting fingers of a hand by alleviating any impact imposed on joint parts of the fingers and allowing the fingers holding a stick to be easily bent.

The foregoing object is achieved by inventions recited in the Scope of Claims. A glove according to the present invention comprises a main body wearable with respect to a hand, the main body comprising finger parts, a back-of-hand part connected to the finger parts, a wrist part connected to the back-of-hand part and serving to protect a wrist, and impact alleviating members for alleviating an impact provided in the finger parts and the back-of-hand part and on a back-of-hand side of the wrist part, wherein the impact alleviating members provided in the finger parts continuously extend from base parts of the fingers through fingertips and has such a flexibility that can follow a bending action of the fingers.

According to the foregoing constitution, when a player bends his/her fingers to thereby firmly hold the stick, the joint parts of the fingers can be surely protected from any impact in the presence of the continuous impact alleviating members covering the joint parts of the fingers. Further, the stick can be firmly held since the impact alleviating member has such a flexibility that can follow the bending action of the fingers.

As a result, the glove capable of reliably protecting the fingers of the hand by alleviating any impact imposed on the joint parts of the fingers and allowing the fingers holding the stick to be easily bent can be provided.

The impact alleviating members each preferably comprises a cover part having a bellows shape and made of hard resin and a core part inserted on an inner side of the cover part and made of soft resin.

According to the foregoing constitution, an impact resistance can be improved because a hardness is obtained on an outer-surface side, and the impact can be flexibly alleviated on the inner side. As a result, the impact transmitted to the hand can be effectively alleviated.

An outermost skin is preferably provided on outer surfaces of the impact alleviating members provided in the finger parts except for sections corresponding to the joints of the fingers.

According to the foregoing constitution, an external appearance can be improved, and the impact alleviating members can be protected.

The cover part preferably has a substantially semicylindrical shape in section, and the core part inserted into the semicylinder and made of soft resin has a semicircle shape in section.

According to the foregoing constitution, the impact resistance with respect to the impact from outside can be improved since the external appearance of the cover part has the substantially semicylindrical shape in section.

A valley and a mountain constituting each of repetitive pitches in the cover part having the bellows shape preferably have a length of approximately 1 to 2 mm and a length of approximately 2 to 4 mm respectively.

According to the foregoing constitution, the fingers can be more easily bent.

The core part is preferably made of foamed resin having a substantially semicircle shape in section.

According to the foregoing constitution, the impact can be more flexibly alleviated, which effectively alleviates the impact transmitted to the hand.

The impact alleviating member may have a substantially semicircular shape in section and be formed from an elastic body including an outer surface having the bellows shape.

According to the foregoing constitution, the impact alleviating member can be integrally formed. As a result, manufacturing steps of the glove can be simplified and reduced, a manufacturing cost of the glove can be thereby curtailed.

DETAILED DESCRIPTION OF THE PREFERRED EMBODIMENTS

Figure 1:
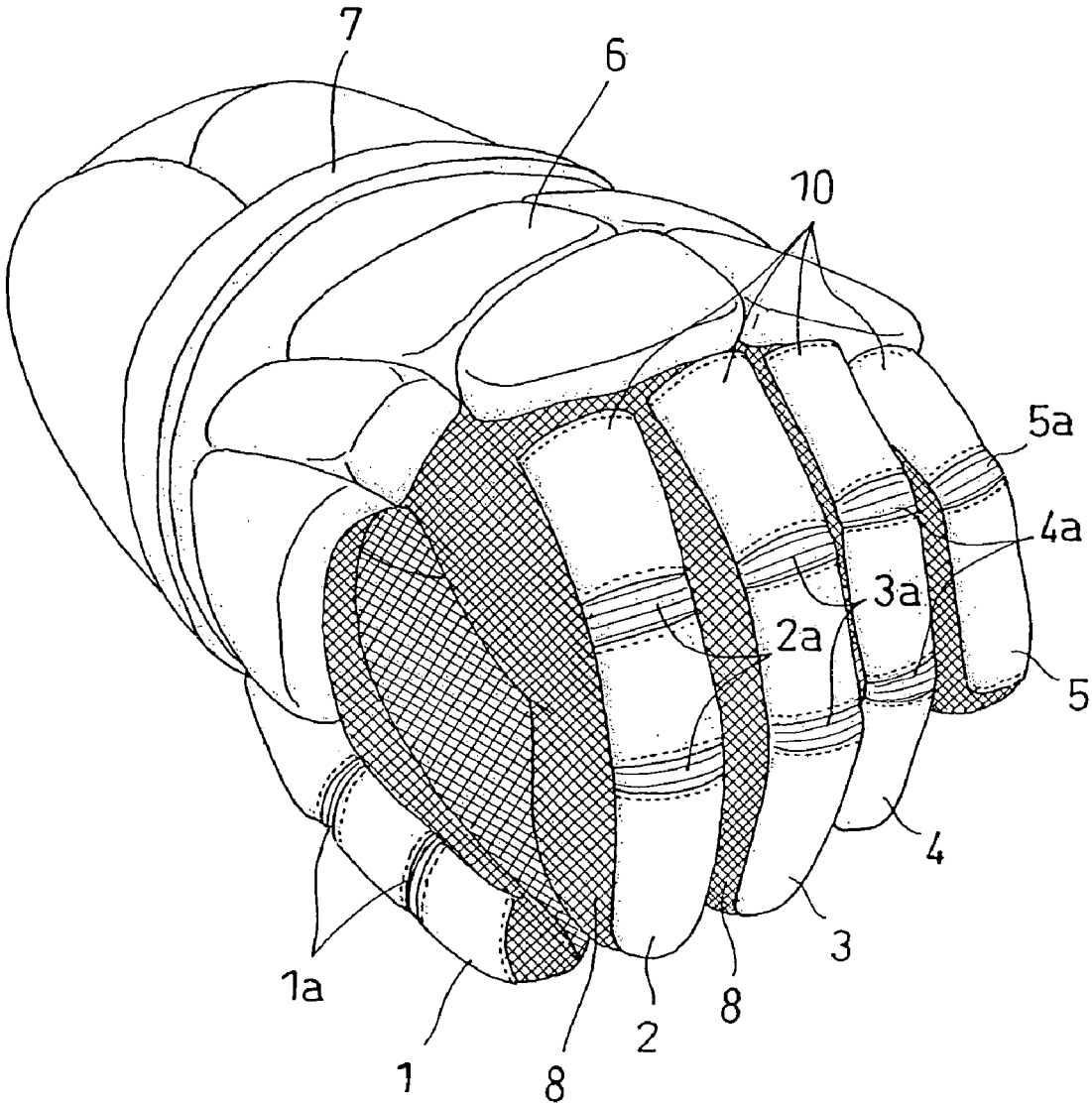
FIG. 1 is a perspective view of a glove for lacrosse according to an embodiment of the present invention observed from a back-of-hand side thereof.
Figure 2:
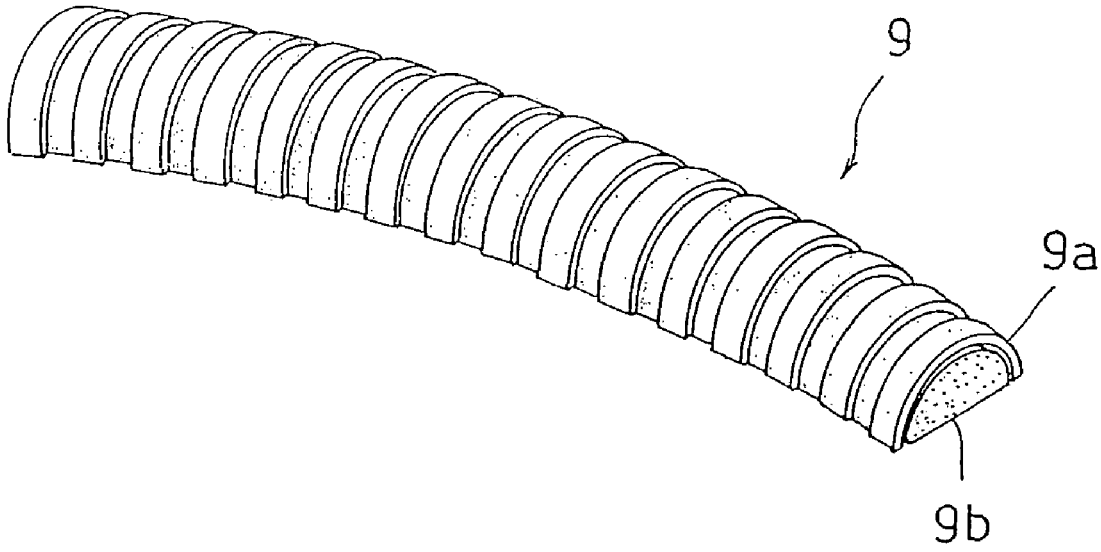
FIG. 2 is a perspective view explaining a structure of an impact alleviating member shown in FIG. 1.
Figure 2A:
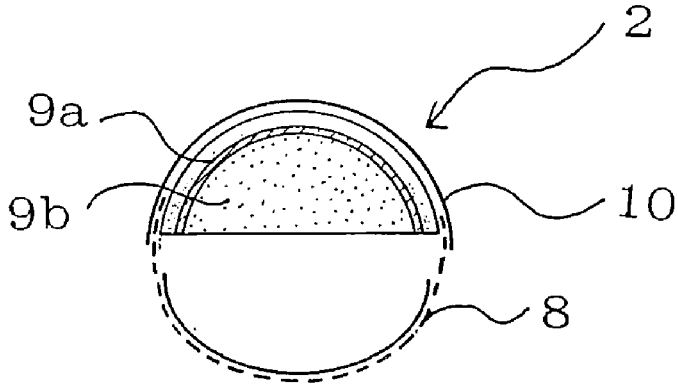
FIG. 2A is a cross-section view explaining a structure of a forefinger part of the glove of FIG. 1 which provides the impact alleviating member of FIG. 2.

Hereinafter, a glove for lacrosse, which is an embodiment of a glove according to the present invention, is described referring to the drawings. FIG. 1 shows a structure of the glove for lacrosse according to the present embodiment on a back-of-hand side thereof. FIG. 2 shows a structure of a reinforced part constituting an internal structure of a finger part and FIG. 2A shows a cross-section structure of a forefinger part of the glove of FIG. 1 which provides the impact alleviating member of FIG. 2.

As shown in FIG. 1, the glove comprises a main body comprising a thumb part 1, a forefinger part 2, a middle finger part 3, a fourth finger part 4, a little finger part 5, a back-of-hand part 6 connected to the finger parts 1 to 5, and a wrist part 7 connected to the back-of-hand part 6 and serving to protect a wrist, and a string (not shown) for fastening the hand tool. An impact alleviating member for alleviating an impact is included in the finger parts 1 to 5 and the back-of-hand part 6, and on the back-of-hand side of the wrist part 7. The impact alleviating members of the finger parts 1 to 5, in particular, continuously extend from base parts of the fingers through fingertips in such a manner that sectional surfaces thereof are substantially identical, and yet have such a flexibility that can follow a bending action of the fingers. FIG. 2 shows the structure of the impact alleviating member.

A cloth 8 formed from a mesh fabric is appropriately provided on side surfaces of the finger parts 1 to 5 and from the base parts of the fingers through a palm-side part. The mesh fabric aggressively evaporates the perspiration during the game. Further, the wrist part 7 is provided with a hook and loop fastener and a string for securely fit the glove to the hand, though not shown, so that the worn glove better fits the hand and the glove cannot be easily disengaged from the wrist. Further, the inserted hand can be freely removed from the glove when the hook and loop fastener or the string is released.

An outermost skin 10 is provided on outer surfaces of the respective fingers 1 to 5. The outermost skin 10 may be formed from leathers of various types, artificial leather, resin or the like, and cut at positions 1*a* to 5*a* (joint parts) corresponding to the respective joints of the fingers so that the fingers can be bent. As a result, the cut sections in the outermost skins 10 at the joints parts cannot be seen when the fingers are stretched, while the cut sections in the outermost skins 10 at the joint parts can be opened in a longitudinal direction of the fingers when the fingers are bent. An impact alleviating member 9 shown in FIG. 2 is incorporated on an inner side of the outermost skin 10. Thus, a surface of the impact alleviating member 9 is coated with the outermost skin 10 in the finger parts of the glove. As an example, FIG. 2A shows the cross-section structure of a forefinger part.

The impact alleviating member 9 comprises a bellows-like thin cover part 9*a* made of hard resin and having a semicylindrical shape in section where valleys and mountains are repeatedly formed at fine pitches on a surface on a back-of-hand side thereof, and a core part 9*b* made of soft foamed resin, having a semicircle shape in section, and inserted on an inner peripheral side of the cover part 9*a*. The cover part 9*a* and the core part 9*b* can be both flexibly bent in response to the bent fingers when the stick is held. An outer diameter of the semicylindrical cover part 9*a* is formed in accordance with a width of the finger, and can be approximately 17 to 20 mm. Referring to the valley and the mountain constituting each of the repetitive pitches of the cover part 9*a*, a length of the valley is preferably approximately 1 to 2 mm, and a length of the mountain is preferably slightly longer than the length of the valley and approximately 2 to 4 mm. The lengths of the valley and the mountain may be equal. A thickness of the hard resin constituting the cover part 9*a* is preferably approximately 0.1 to 0.5 mm, or may be thinner as far as a certain degree of strength can be obtained.

Therefore, when the fingers are bent, the impact alleviating members 9 are flexibly bent while the outer skins 10 at the sections corresponding to the joints are opened in the longitudinal direction of the fingers. As a result, the player can easily hold the stick. Further, the sections corresponding to the joints are effectively protected from any impact generated from the sticks clashing with one another by the cover part 9*a* made of hard resin and the core part 9*b* made of soft foamed resin. Accordingly, the impact with respect to the hands can be reduced when the joint parts are attacked by the competitor's stick. As a result, possible troubles in the game and injuries such as bone fractures can be reliably prevented.

A material used for the cover part 9*a* made of hard resin is not particularly limited as far as it is appropriately hard and flexibly bendable, and any of engineering plastics of different types having a superior strength, such as ABS resin, is preferably used. A material used for the core part 9*b* made of soft foamed resin is not particularly limited as far as it is flexible and capable of significantly alleviating the impact, and EVA (ethylene vinyl acetate copolymer), foamed PET (polyethylene terephthalate) or the like can be suitably used as the material.

ANOTHER EMBODIMENT

Figure 3:
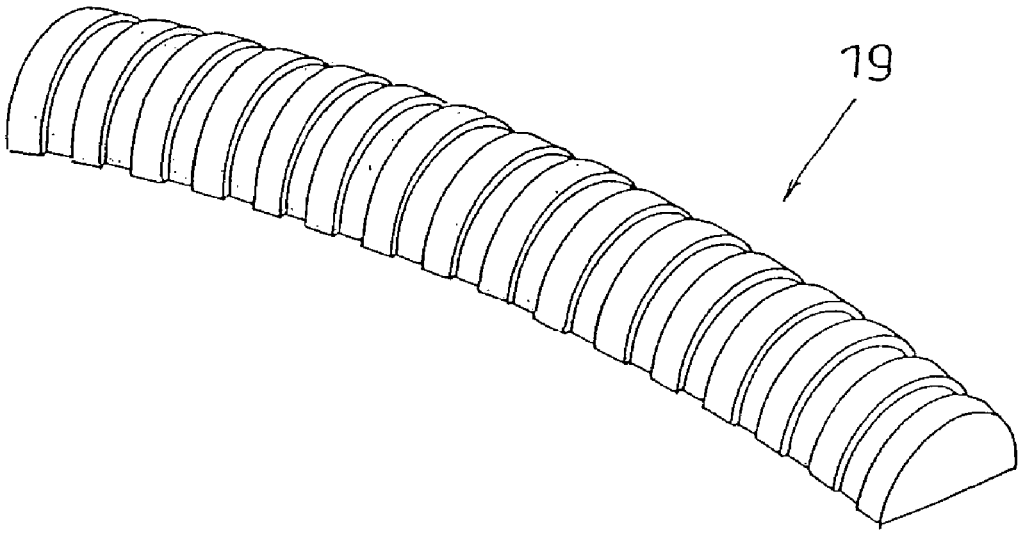
FIG. 3 is a perspective view showing a structure of an impact alleviating member according to another embodiment of the present invention.

1) In the description of the foregoing embodiment, the glove for lacrosse was exemplified, however, the present invention can be applied to a glove for ice hockey, and further, glove for baseball and softball. In that case, the impact alleviating member may be provided between an outer skin and an inner skin constituting a back-of-hand side of finger parts in these gloves.
2) In the example described in the foregoing embodiment, the impact alleviating member comprises the thin cover part 9*a* made of hard resin and having the bellows shape and the core part 9*b* inserted on the inner peripheral side of the cover part 9*a*, made of soft foamed resin and having the substantially rectangular shape in section. In place of the constitution, the cover part 9*a* and the core part 9*b* may be integrally formed. More specifically, an impact alleviating member 19, as shown in FIG. 3, has a substantially semicircular shape in section and an outer surface having a bellows shape, and is formed into an integral shape by means of thermoplastic elastomer such as polyurethane elastomer or an elastic body such as silicon rubber. The formation of the impact alleviating member 19 in the foregoing manner results in reduction of manufacturing steps and a manufacturing cost of the glove.

What is claimed is:

1. A glove comprising a main body wearable with respect to a hand, the main body comprising:

finger parts;

a back-of-hand part connected to the finger parts;

a wrist part connected to the back-of-hand part and serving to protect a wrist: and impact alleviating members for alleviating an impact provided in the finger parts and the back-of-hand part and on a back-of-hand side of the wrist part, wherein the impact alleviating members provided in the finger parts continuously extend from base parts of the fingers through fingertips and has such a flexibility that can follow a bending action of the fingers, and wherein the impact alleviating members each comprises a cover part having a bellows shape and made of hard resin and a core part inserted on an inner side of the cover part and made of soft resin.

2. The glove as claimed in claim 1, wherein the cover part has a substantially semicylindrical shape in section, and the core part inserted into the semicylinder and made of soft resin has a substantially semicircle shape in section.

3. The glove as claimed in claim 1, wherein a valley and a mountain constituting each of repetitive pitches in the cover part having the bellows shape, said valley having a length of approximately 1 to 2 mm, said mountain having length of approximately 2 to 4 mm.

4. The glove as claimed in claim 1, wherein the core part is made of foamed resin having a substantially semicircle shape in section.

5. A glove comprising a main body wearable with respect to a hand, the main body comprising:

finger parts;

a back-of-hand part connected to the finger parts;

a wrist part connected to the back-of-hand part and serving to protect a wrist: and impact alleviating members for alleviating an impact provided in the finger parts and the back-of-hand part and on a back-of-hand side of the wrist part, wherein the impact alleviating members provided in the finger parts continuously extend from base parts of the fingers through fingertips and has such a flexibility that can follow a bending action of the fingers, and wherein an outermost skin is provided on respective outer surfaces of the impact alleviating members provided in the finger parts except for sections corresponding to joints of the fingers.

6. A glove comprising a main body wearable with respect to a hand, the main body comprising:

finger parts;

a back-of-hand part connected to the finger parts;

a wrist part connected to the back-of-hand part and serving to protect a wrist: and impact alleviating members for alleviating an impact provided in the finger parts and the back-of-hand part and on a back-of-hand side of the wrist part, wherein the impact alleviating members provided in the finger parts continuously extend from base parts of the fingers through fingertips and has such a flexibility that can follow a bending action of the fingers, and wherein the impact alleviating member has a substantially semicircular shape in section and is formed from an elastic body including an outer surface having a bellows shape.

7. The glove as claimed in claim 6, wherein an outermost skin is provided on respective outer surfaces of the impact alleviating members provided in the finger parts except for sections corresponding to joints of the fingers.

8. The glove as claimed in claim 6, wherein a valley and a mountain constituting each of repetitive pitches in the cover part having the bellows shape, said valley having a length of approximately 1 to 2 mm, said mountain having a length of approximately 2 to 4 mm.

* * * * *